US010526156B2

(12) United States Patent
Vergentini et al.

(10) Patent No.: US 10,526,156 B2
(45) Date of Patent: Jan. 7, 2020

(54) MACHINE AND METHOD FOR THE WINDING OF STRIPS OF WEB MATERIAL WITH MEANS FOR TRANSVERSAL CUTTING OF THE STRIPS AND ANCHORING OF THE STRIPS TO THE WINDING CORE

(71) Applicant: A.CELLI NONWOVENS S.P.A., Porcari (IT)

(72) Inventors: Francesco Vergentini, Pieve a Nievole (IT); Riccardo Paladini, Bagni di Luca (IT)

(73) Assignee: A. CELLI NONWOVENS S.P.A., Porcari (LU) (IT)

( * ) Notice: Subject to any disclaimer, the term of this patent is extended or adjusted under 35 U.S.C. 154(b) by 224 days.

(21) Appl. No.: 15/591,276

(22) Filed: May 10, 2017

(65) Prior Publication Data

US 2017/0327338 A1 Nov. 16, 2017

(30) Foreign Application Priority Data

May 11, 2016 (IT) ..... 102016000048298

(51) Int. Cl.
*B65H 19/22* (2006.01)
*B65H 19/28* (2006.01)
(Continued)

(52) U.S. Cl.
CPC ..... *B65H 19/2284* (2013.01); *B65H 19/2207* (2013.01); *B65H 19/265* (2013.01);
(Continued)

(58) Field of Classification Search
CPC ..... B65H 19/2207; B65H 19/2284; B65H 19/265; B65H 19/283
See application file for complete search history.

(56) References Cited

U.S. PATENT DOCUMENTS

2003/0047632 A1 3/2003 Duncan
2004/0135023 A1* 7/2004 Bohm ..... B65H 19/2261 242/527.2

(Continued)

FOREIGN PATENT DOCUMENTS

EP 0147123 A2 * 7/1985 ..... B65H 18/16
EP 1174377 A2 * 1/2002 ..... B65H 19/2238

(Continued)

*Primary Examiner* — William E Dondero
(74) *Attorney, Agent, or Firm* — McGlew and Tuttle, P.C.

(57) ABSTRACT

A machine (1) includes an unwinding section (3) for unwinding parent reels (Ba, Bb) of web material (N), an unwinding section (3) for unwinding parent reels (Ba, Bb) of web material (Na, Nb), and at least one winding station (15). The winding station in turn includes a winding device (41, 51), to which a longitudinal strip (S) of web material is fed. In the winding station, a respective spool (B) of web material is formed. The winding station (15) further includes: a cutting device (81, 83) for the longitudinal strip (S), to cut the longitudinal strip (S) transversely, thus forming a tail edge, which remains on the spool (B) under formation, and a leading edge; and a holding device (85) for holding the leading edge of the longitudinal strip (S), to transfer the leading edge onto a tubular winding core (T) of a new spool to be wound.

23 Claims, 16 Drawing Sheets

(51) Int. Cl.
*B65H 19/26* (2006.01)
*B65H 35/02* (2006.01)

(52) U.S. Cl.
CPC ..... *B65H 19/283* (2013.01); *B65H 35/02* (2013.01); *B65H 2301/4148* (2013.01); *B65H 2301/41421* (2013.01); *B65H 2301/414321* (2013.01); *B65H 2406/122* (2013.01); *B65H 2406/351* (2013.01); *B65H 2701/18444* (2013.01)

(56) References Cited

U.S. PATENT DOCUMENTS

| | | | | |
|---|---|---|---|---|
| 2006/0076449 | A1 | 4/2006 | Stitz et al. | |
| 2009/0283621 | A1 | 11/2009 | Suzuki | |
| 2013/0248641 | A1 | 9/2013 | Niwa et al. | |
| 2013/0248642 | A1* | 9/2013 | Niwa ..... | B65H 19/26<br>242/522 |
| 2013/0284847 | A1 | 10/2013 | Hou | |

FOREIGN PATENT DOCUMENTS

| | | | |
|---|---|---|---|
| EP | 2 644 543 | A2 | 10/2013 |
| WO | 2015/140466 | A1 | 9/2015 |

* cited by examiner

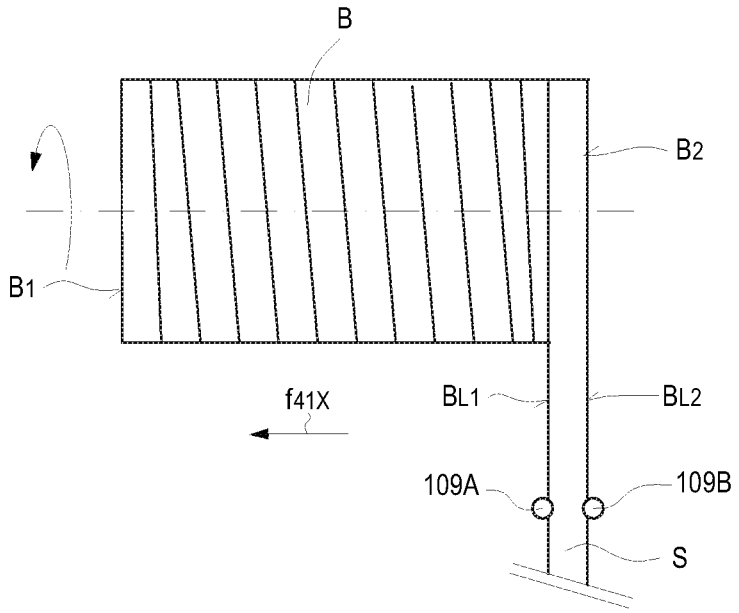
Fig.9A
Fig.9B
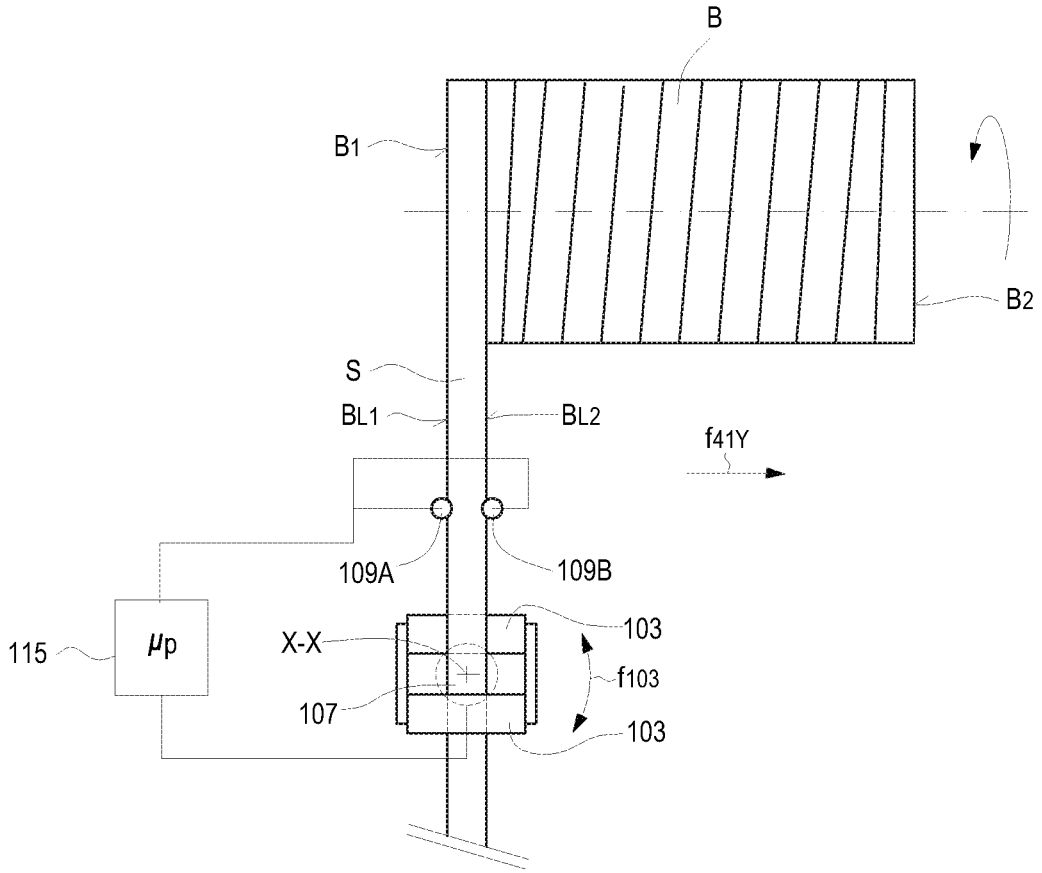

MACHINE AND METHOD FOR THE WINDING OF STRIPS OF WEB MATERIAL WITH MEANS FOR TRANSVERSAL CUTTING OF THE STRIPS AND ANCHORING OF THE STRIPS TO THE WINDING CORE

TECHNICAL FIELD

This invention relates to machines for the production of spools of web material, for example for the production of spools formed from strips of non-woven fabric.

Embodiments described here relate, in particular, to improvements in the system for severing the strip of web material on completing formation of one spool and starting winding of the next spool.

BACKGROUND ART

In many industrial sectors it is necessary to transform reels of web material of one size into spools of a different size, by means of a process of un-winding parent reels, or so-called jumbo reels, and rewinding them into spools with different size characteristics. In some cases the web material from a single parent reel is unwound and divided into longitudinal strips, each of which is wound onto a helically wound spool. The finished spools obtained in this way are used as semi-finished products to feed production lines for other articles.

Machines that produce spools of helically wound web material from parent reels are sometimes called spooling machines. The web material can, for example, be a non-woven fabric. The helically wound spools that are obtained are used, for example, to feed machines for the production of sanitary towels, diapers and other hygienic and sanitary articles. The web material wound on the parent reels sometimes has a transversal size (corresponding to the axial dimension of the parent reel) 5-15 times the width of the individual longitudinal strips that are obtained by longitudinal cutting of the web material on the parent reels. The individual strips are fed simultaneously to helical winding stations, in each of which a helically wound spool is formed. The winding stations are arranged in line one after the other in a machine direction, defined by the direction of advance of the longitudinal strips obtained by cutting the material from the parent reels. Each strip is fed to the respective winding station along a feed path.

When a helically wound spool has been completed, the longitudinal strip must be severed, the completed helically wound spool must be removed from the respective winding station and replaced with a new winding core, to which the leading edge of the strip must be anchored to start winding of the next spool.

WO-A-2015/140466 describes a helical winding station in a spooling machine with a system to generate a perforation in the longitudinal strip on completing winding of a helically wound spool. The perforated line represents a pre-tear line to break the continuity of the longitudinal strip. Tearing along the perforated line is carried out by pulling on the longitudinal strip. The publication mentioned above does not describe means for starting the next winding operation on the new winding core.

There is thus a need to improve the machines for the formation of spools of web material, for example, but not restricted to helical winding spooling machines, as regards severing of the longitudinal strip on completing the winding of one spool and starting the winding of the next spool.

SUMMARY

To solve or alleviate the problems and limitations of the winding machines according to the state of the art, in particular as regards the transitional stage of stopping the winding of a completed spool and starting the winding of the next spool, a machine is provided, comprising: an unwinding section for unwinding parent reels of web material; a cutting station arranged downstream of the unwinding section and comprising cutting members adapted to divide the web material coming from the unwinding section into longitudinal strips; and a plurality of winding stations arranged in sequence downstream of the cutting station, each of which is adapted to receive a respective longitudinal strip. Each winding station comprises a winding device, to which a respective longitudinal strip of web material is fed, and in which a respective spool of web material is formed. Each winding device can comprise a winding mandrel provided with a rotation movement around the rotation axis and with a reciprocating translation movement in a direction parallel to the rotation axis, so as to helically wind the longitudinal strip around the winding mandrel. Advantageously, each winding station may further comprise: a cutting device for the longitudinal strip fed to the winding station, to cut the longitudinal strip transversally, thus forming a trailing edge, which remains on the spool under formation, and a leading edge; and a holding device for holding the leading edge of the longitudinal strip, to transfer the leading edge onto a winding core of a new spool to be wound.

A machine configured in this way allows for a faster and more reliable phase of stopping the winding of one longitudinal strip, when the respective spool formed in the winding station has been completed, and the phase of starting the winding of a new spool.

The machine configured in this way is substantially a start-stop machine, in the sense that at the end of the winding of one spool, feeding of the strip of web material is stopped to perform cutting of the longitudinal strip, removal of the formed spool, its replacement with a new tubular winding core, and adhesion of the leading edge to the new tubular core, before starting again with winding of a new spool.

The system for cutting the longitudinal strip, holding the leading edge and adhesion of the leading edge to a new tubular winding core is particularly advantageous when it is implemented in a so-called spooling machine, in which the longitudinal strip is helically wound. In this case the machine may have a winding station in which the spool is provided with a rotation movement around the rotation axis and a reciprocating translation movement, in a direction parallel to the rotation axis.

For that purpose, the winding station may comprise, for example, a winding mandrel, on which the tubular winding core is fitted, and which is provided with a rotation movement around its own axis and with a reciprocating translation movement, parallel to its own axis.

The machine may comprise in some cases a contact roller in each winding station, configured and arranged to press against the outer cylindrical surface of the spool being formed. The contact roller may be mounted idle on an arm or on a pair of arms provided with a pivoting movement to move towards the spool being formed in the winding station. In advantageous embodiments the contact roller is associated with the winding mandrel and its axis is substantially parallel to the axis of the winding mandrel, i.e. to the axis of rotation of the spool.

In some embodiments, the contact roller, optionally the cutting device and the holding device are carried by a pivoting arm, provided with a pivoting movement in order to move towards and away from the axis of the winding mandrel. The pivoting arm may be mounted on a carriage carrying the winding mandrel and movable transversally with a reciprocating motion in a direction substantially parallel to the rotation axis of the winding mandrel.

The holding device, for example a suction device, may be movable between: a first position, where it co-acts with the cutting device to cut the longitudinal strip transversally; and a second position, where it holds the leading edge of the longitudinal strip between the contact roller and the tubular winding core of the new spool to be wound, mounted on the winding mandrel.

The suction device may comprise a suction box. The contact roller and the suction box may be approximately the same length, i.e. approximately the same size in the direction of the contact roller axis. In some embodiments the suction box is provided with a rotation movement around the rotation axis of the contact roller.

To obtain a configuration that is compact and easy to control, the suction box may be integral with a counter blade, co-acting with a blade, the counter blade and the blade forming the cutting device.

In advantageous embodiments, each winding station may further comprise an adhesion member to make the leading edge of the longitudinal strip adhere to the new spool to be wound, and more particularly to a tubular winding core. For example, the adhesion member is an electrostatic member. In this way it is possible to avoid inserting into the helically wound spool a material other than the wound web material, for example glue or adhesive tape, to anchor the leading edge of the longitudinal strip to the winding core.

For example, the adhesion member may comprise an electrostatic bar, configured and arranged to charge electrostatically a winding core fitted on the winding mandrel.

According to some embodiments the adhesion member is mounted on a guiding arm for guiding the longitudinal strip. The guiding arm may comprise a guiding roller, with a rotation axis substantially parallel to the axis of the winding mandrel. The guiding arm may be carried by a slide movable parallel to the axis of the winding mandrel, with a movement independent of the reciprocating translation movement of the winding mandrel parallel to the axis of the latter.

According to another aspect, a method is disclosed for winding a longitudinal strip onto a spool being formed in a winding station, with a machine as described above. The method may comprise the following steps to be performed in each winding station:

winding a length of the longitudinal strip onto a first spool being formed around the winding mandrel;

severing the longitudinal strip by means of the cutting device, forming a trailing edge of the first spool and a leading edge of a second spool, the leading edge being held by the holding device;

removing the first spool from the winding station;

inserting a new tubular winding core in the winding station;

by means of the holding device, moving the leading edge towards the new tubular winding core;

making the leading edge adhere to the new core;

starting winding a new spool around the new tubular winding core.

Further advantageous features and embodiments of the machine and method according to the invention are illustrated in the description that follows and in the attached claims, which form an integral part of this description.

BRIEF DESCRIPTION OF THE DRAWINGS

The invention will be better understood by following the description and the enclosed drawing, which shows a practical and non-limiting embodiment of the invention. More specifically, in the drawing

FIGS. 9A and 9B show a diagram for controlling the position of the longitudinal edges of the longitudinal strip with respect to the ends of the spool during the winding phase.

DETAILED DESCRIPTION OF EMBODIMENTS

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

In the following, specific reference is made to a spooling machine, i.e. to a helical winding machine, in which a web material is divided into a plurality of longitudinal strips, which are fed in parallel to a plurality of winding stations. In each winding station the winding devices are configured to form helically wound spools, giving the spool being formed a rotation movement around a rotation axis, and a reciprocating translation movement in a direction parallel to the axis of rotation. In other embodiments, not shown, a single winding station may be provided, if necessary with helical winding. In other embodiments, one or more winding stations may be provided for spiral winding, i.e. without the reciprocating translation movement.

Figure 1:
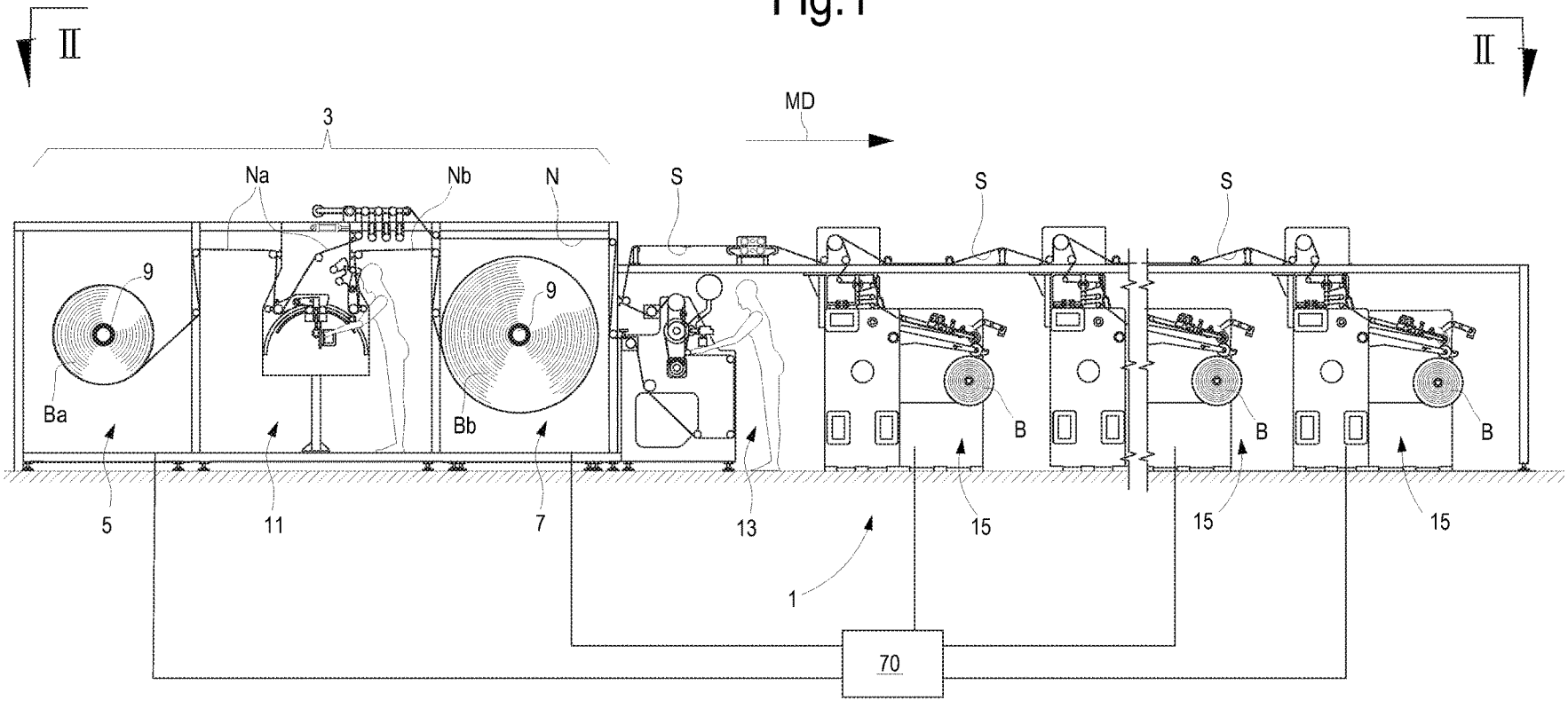
FIG. 1 shows a side view of the machine with its main stations.

FIG. 1 shows an overall side view of the machine for the production of helically wound spools. The machine is in reality a converting line inclusive of a plurality of stations. The machine is indicated as a whole by 1. It has an unwinding section 3, in which parent reels, also known as master rolls or jumbo rolls, are positioned, indicated with Ba and Bb in FIG. 1. In the embodiment illustrated, the unwinding section 3 comprises a first unwinding station 5 and a second unwinding station 7. The two unwinding stations 5 and 7 may be substantially symmetrical, and each have an unwinding mandrel, indicated with 9, on which the parent reels Ba, Bb are mounted. These latter contain a certain amount of web material, indicated with Na and Nb for the reels Ba and Bb of FIG. 1.

Between the two unwinding stations 5, 7 a cutting and welding station 11 may be arranged, wherein the tail of a web material from an exhausted parent reel positioned in one of the unwinding stations 5, 7 is welded to the leading edge of a web material on a parent reel standing-by in the other of the two unwinding stations 5, 7, to allow continuous working using a number of parent reels in sequence. The welding of web materials coming from successive parent reels takes place after slowing down or temporary stopping the unwinding of the reel that is finishing, as the machine described is of the start-stop type. In other embodiments the welding station may be located downstream of the two unwinding stations 5, 7. In yet other embodiments, more than two unwinding stations may be provided.

Figure 2:
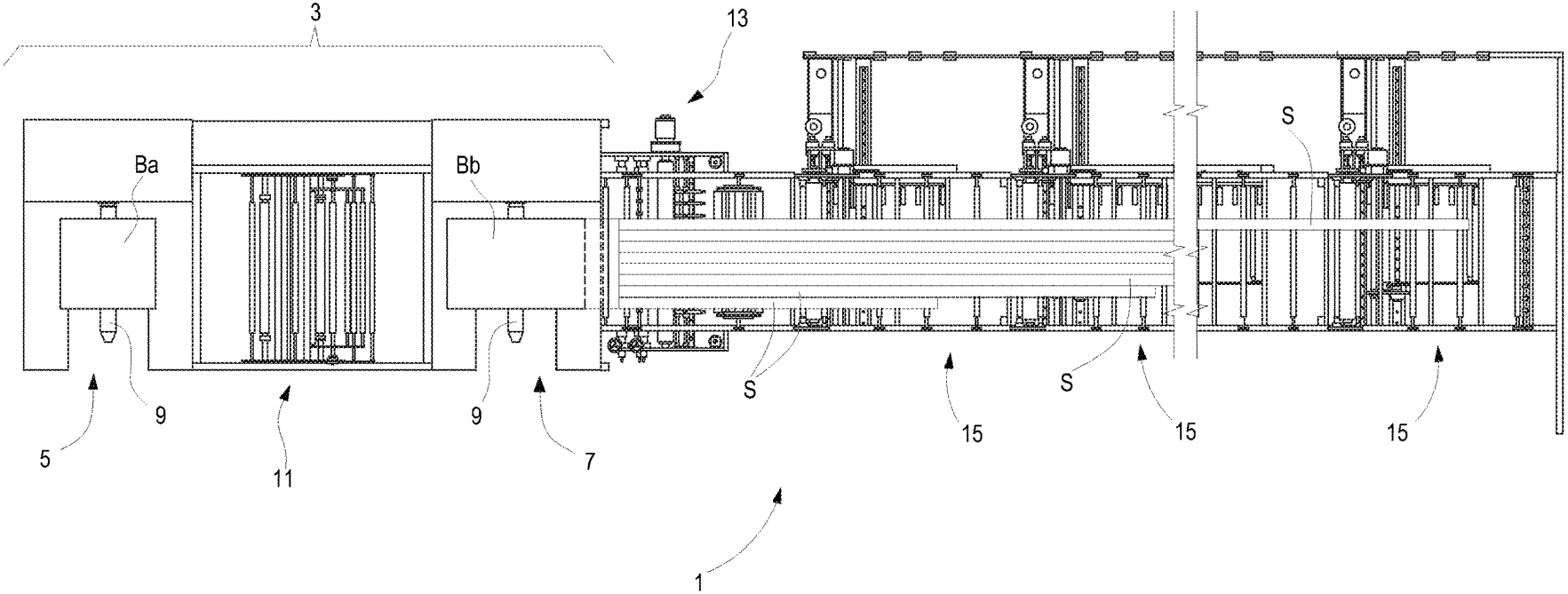
FIG. 2 shows a plan view along II-II of FIG. 1.

Downstream of the unwinding section 3 a cutting station 13 is provided, in which the web material fed by the unwinding section, generically indicated with N, is cut longitudinally and divided into a plurality of longitudinal strips S, which are fed to a plurality of helical winding stations, which can be the same as each other, each one indicated with 15. The helical winding stations 15 are arranged in sequence according to the machine direction, generically indicated by the arrow MD and represented by the direction in which the longitudinal strips S advance. For the purpose of illustration, FIGS. 1 and 2 are partial representations of just three winding stations 15, but it must be understood that the number of winding stations may vary from two to ten or more, if necessary, according to the number of longitudinal strips S into which a web material N can be divided.

Each strip S into which the web material N coming from the unwinding section 3 is divided advances along a path from the cutting station 13 to the respective winding station 15. In advantageous embodiments the feed path is located over the winding stations, but the option of arranging the feed paths under the winding stations must not be excluded.

The length of the path of each longitudinal strip S is different from the length of the paths of the remaining longitudinal strips, and depends on the position of the respective winding station 15, to which the longitudinal strip is fed.

Generically indicated with 70 is a control unit, for example a microprocessor, a micro-computer or a PLC, to control one or more of the stations making up the machine 1. In some embodiments the machine 1 may be provided with a plurality of PLCs or other dedicated local control units, for example, to supervise the operation of a part, section or station in the machine 1. The central unit 70 may be assigned to supervise and co-ordinate various local control units or local PLCs. In other embodiments a single control unit may be provided to manage the whole line or machine 1, or a plurality of the stations thereof.

Figure 3:
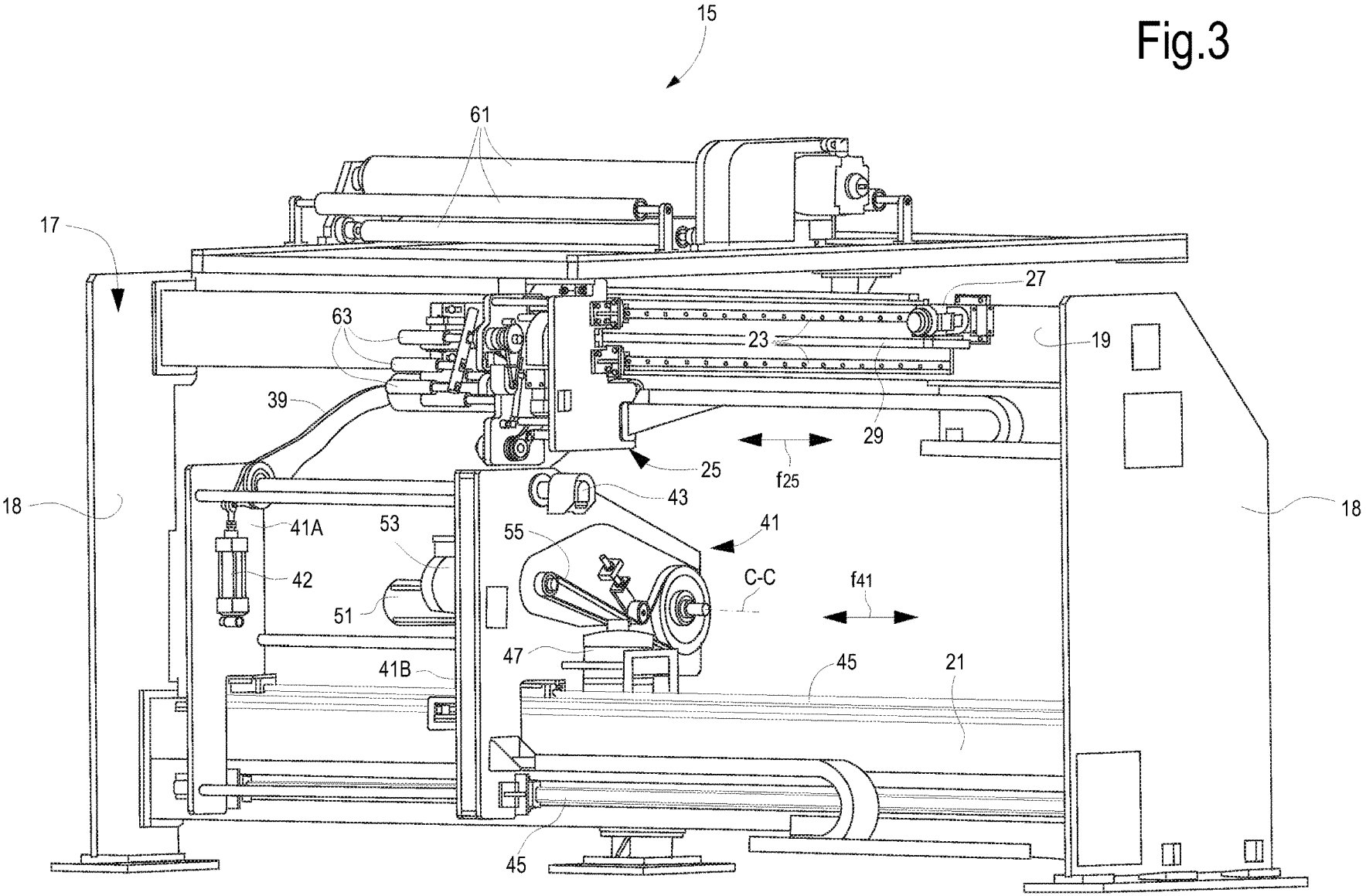
FIGS. 3 and 4 show axonometric views of a helical winding station.
Figure 4:
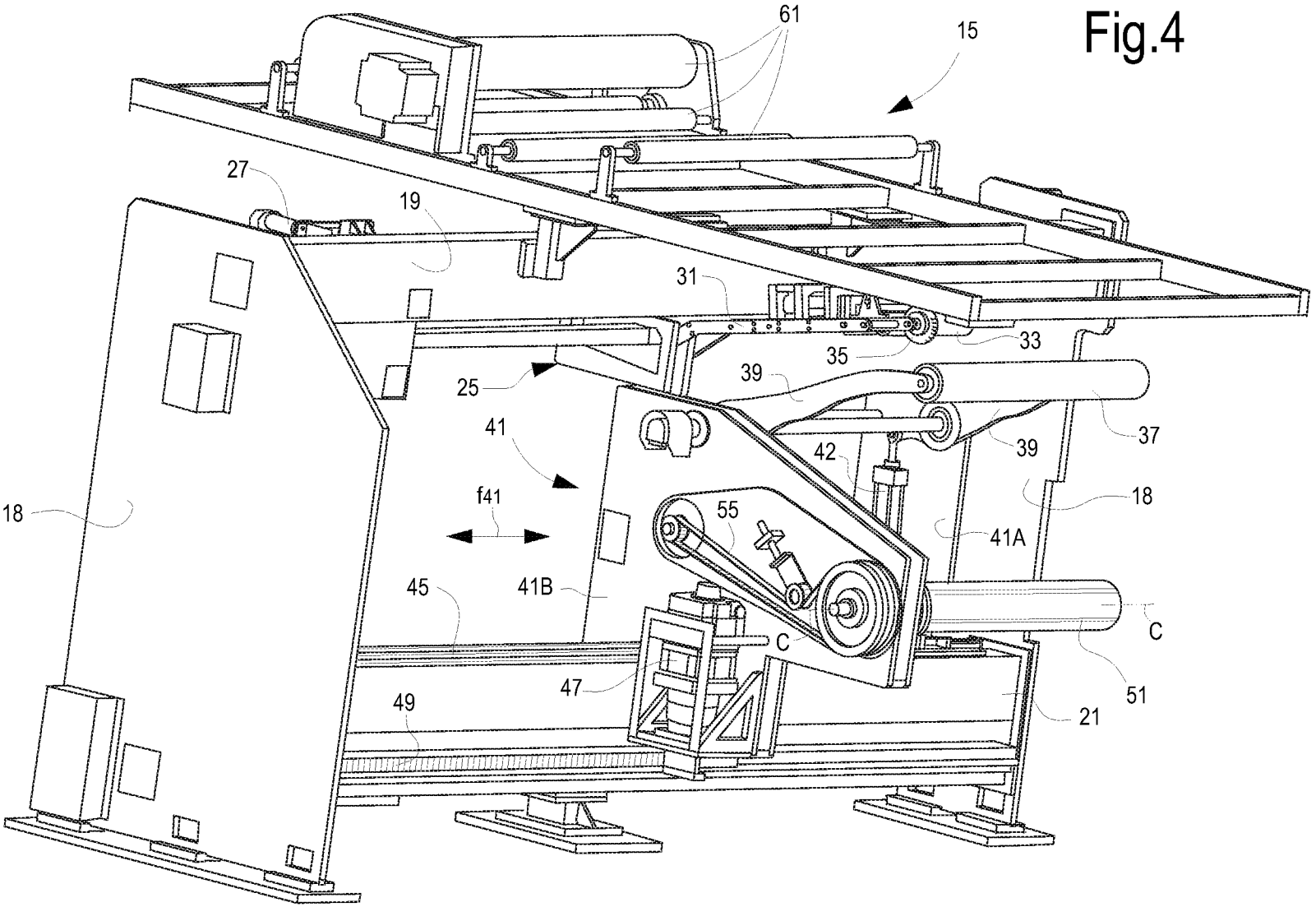
Figure 5:
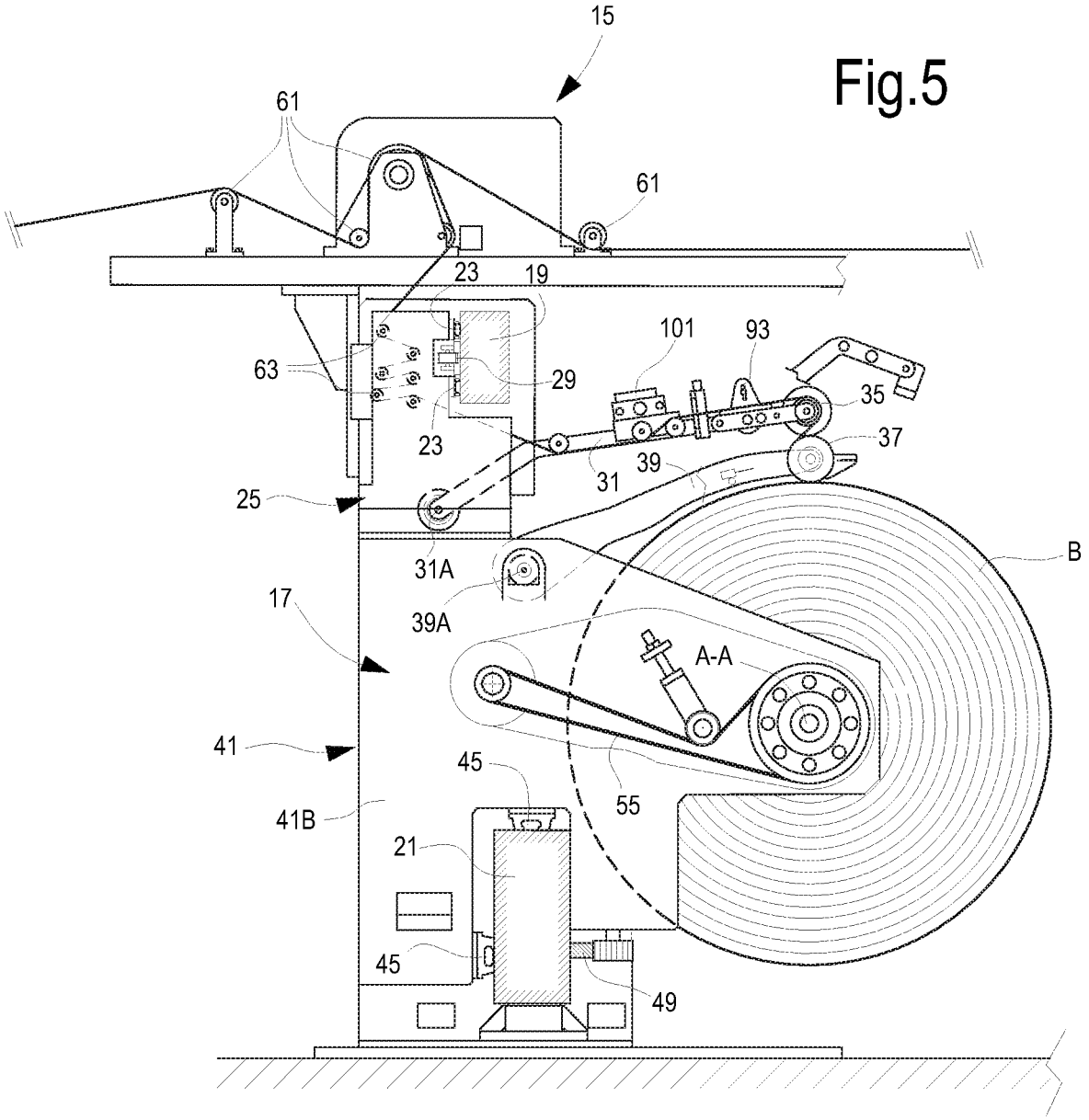
FIG. 5 shows an enlarged side view of a helical winding station.
Figure 6:
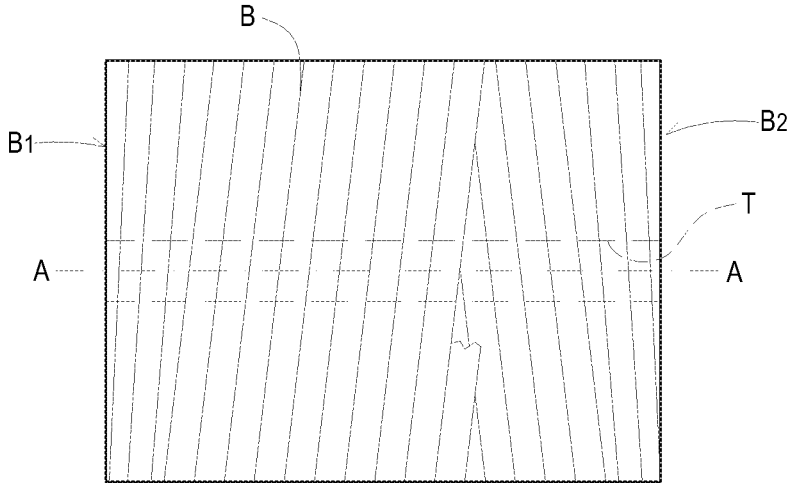
FIG. 6 shows a diagram of a helically wound spool obtained using a helical winding station according to FIGS. 3 to 5.

FIGS. 3-5 show in greater detail a possible configuration of a helical winding station 15, while FIG. 6 shows a diagram view of a helically wound spool obtained using a winding station 15. As shown in FIG. 6, the strip S that forms the helically wound spool B forms helical turns around a tubular winding core T. A-A indicates the winding axis of the helically wound spool B, and B1, B2 indicate the two axial ends of the helically wound spool B.

The general structure of the helical winding station 15 is clearly shown in FIGS. 3 to 5. It comprises a bearing structure 17, which may comprise a pair of side walls 18, an upper crossbeam 19 and a lower crossbeam 21 joining the two side walls 18. On the upper crossbeam 19 first guides 23 can be provided, along which a slide 25 can move in a direction f25. Reference 27 indicates a motor that, by means of a belt 29, a threaded bar or other suitable transmission member, controls the movement of the slide 25 along the guides 23. In other embodiments, the movement may be controlled by an electric motor mounted on the slide 25, which rotates a pinion meshing with a rack constrained to the crossbeam 21.

The slide 25 carries a pivoting guide arm 31, pivoted at 31A to the slide 25 and which has the function of guiding the longitudinal strip S fed to the helical winding station 15. The guide arm 31 can support at its distal end a guide roller 33, having an axial length sufficient to receive the longitudinal strip S having the maximum width allowed by the machine 1. The guide arm 31 may be lifted and lowered by pivoting around the axis 31A. In some embodiments the guide roller 33 may be interchangeable according to the transversal size of the longitudinal strip S, for instance.

A wheel or support roller 35 can be mounted coaxially to the guide roller 33, with which the guide arm 31 rests on a contact roller 37. The contact roller 37 may be idly mounted on arms 39 hinged around a pivoting axis 39A to a carriage 41. Reference number 42 indicates a cylinder-piston actuator that can control the lifting and lowering movement of the arms 39 around the pivoting axis 39A. The arms 39 can be associated with an encoder 43 that can detect the angular position of the arms 39 with respect to the carriage 41.

The carriage 41 may comprise two side walls 41A, 41B joined together by crossbeams, bars or beams. Carriage 41 may move with a reciprocating translation motion according to the double arrow f41 along guides 45 that can be constrained to the lower beam 21. The reciprocating translation motion of carriage 41 according to the double arrow f41 can be controlled by an electric motor 47. In the embodiment illustrated the electric motor 47 is mounted on the carriage 41 and comprises a pinion in mesh with a rack 49 constrained to the beam 21. In other embodiments, other drive mechanisms can be foreseen, for example using a fixed motor and a screw or threaded bar. By co-acting with a stationary rack 49, the motor 47 on board the carriage 41 allows high linear accelerations of the carriage 41 to be obtained.

A winding mandrel 51 can be mounted on the carriage 41, with a rotation axis substantially parallel to the axis of the contact roller 37 and to the pivoting axis 39A or the arms 39 that supports the contact roller 37, as well as to the reciprocating straight movement direction according to f41 of the carriage 41. The winding mandrel 51 can be driven into rotation by an electric motor 53 that can be carried by the carriage 41. For example, the winding mandrel 51 and the motor 53 can be carried by the side wall 41B of the carriage 41. A belt 55 can be provided to transmit the motion from the motor 53 to the winding mandrel 51. The rotation axis of the winding mandrel 51 is labeled C-C. This rotation axis coincides with the axis A-A of the spool B forming around the winding mandrel 51.

The structure described above allows the winding mandrel 51 to perform a double winding motion, and more specifically: a rotation movement around its own axis C-C, controlled by motor 53; and a reciprocating translation motion indicated by the double arrow f41 and controlled by motor 47. When a tubular winding core T is mounted on the winding mandrel 51, helical winding of the longitudinal strip S illustrated in FIG. 6 is achieved. During the helical winding movement the guide roller 33 may remain substantially stationary in the transversal direction, i.e. in direction f25, while it may rise gradually, together with the contact roller 37, as the diameter of the helically wound spool B increases in size. The encoder 43 may detect the angular position of the arms 39 and may therefore provide a measurement of the diameter of the helically wound spool B being formed on the winding mandrel 51.

Guide rollers for the longitudinal strips S above the winding stations 15 are indicated with 61. Tensioning rollers for the longitudinal strip S fed to each of the winding stations 15 are indicated with 63. The tensioning rollers 63 define a zig-zag path for the longitudinal strip S to form a sort of festoon. Some of the tensioning rollers 63 have a mobile axis to maintain the longitudinal strip S tensioned as required.

The machine 1 described so far operates as follows. At least one parent reel Ba or Bb is placed in at least one of the two unwinding stations 5, 7. The web material Na or Nb from the parent reel is unwound and fed through the cutting station 13, where the web material is cut into a plurality of longitudinal strips S. Each longitudinal strip S is fed to one of the helical winding stations 15 to form respective helically wound spools B. In order to be formed, each helically wound spool B usually requires the use of more than one parent reel Ba, Bb. Typically, between two and five parent reels Ba, Bb are necessary to form a series of helically wound spools B, but this number must not be considered to be limiting. As a result, when a parent reel unwinding in one of the unwinding stations 5, 7 finishes, its trailing edge is joined to the leading edge of a second parent reel that has been prepared and is waiting in the other of the two unwinding stations 5, 7. Welding takes place in the welding station 11. Welding usually takes place at low speed or with the machine stopped. Consequently, the machine 1 is slowed down or stopped when the parent reel being used has to be replaced. In other embodiments a supply of web material or longitudinal strips S can be provided, formed for example using a plurality of mobile guiding rollers. This supply may allow the winding stations 15 to continue working, if necessary at a reduced speed, even if the parent reels are stopped and no web material Na, Nb is being delivered by the unwinding station 3 for the time necessary to replace the parent reel.

When the helically wound spools B have been completed, they are removed from the winding mandrels 51 in the winding stations 15 and replaced by new tubular winding cores to start the next winding process.

The operation is usually carried out in such a way that all the helically wound spools B are completed at the same time, and can thus be replaced all together, stopping the machine 1 for the minimum amount of time possible. For that purpose the machine 1 is slowed down until it stops, that is to say until the feeding speed of the longitudinal strips S is reduced to zero.

In some embodiments, each winding station 15 comprises a transversal cutting device to cut the longitudinal strip B when the helically wound spool B has been completed. Furthermore, each winding station 15 may comprise a holding device, to hold a leading edge of the longitudinal strip, generated by cutting said longitudinal strip, and to bring the leading edge up to a new tubular winding core that is inserted on the winding mandrel after removal of the completed helically wound spool.

In some embodiments, the cutting device may comprise a blade 81. This may be carried by the guide arm 31, or by the pivoting arms 39, as schematically shown in FIGS. 8A-8H. The blade 81 may be a toothed blade. The cutting device may also comprise a counter blade 83, which may be mounted on the arms 39 in the manner described below.

Figure 7:
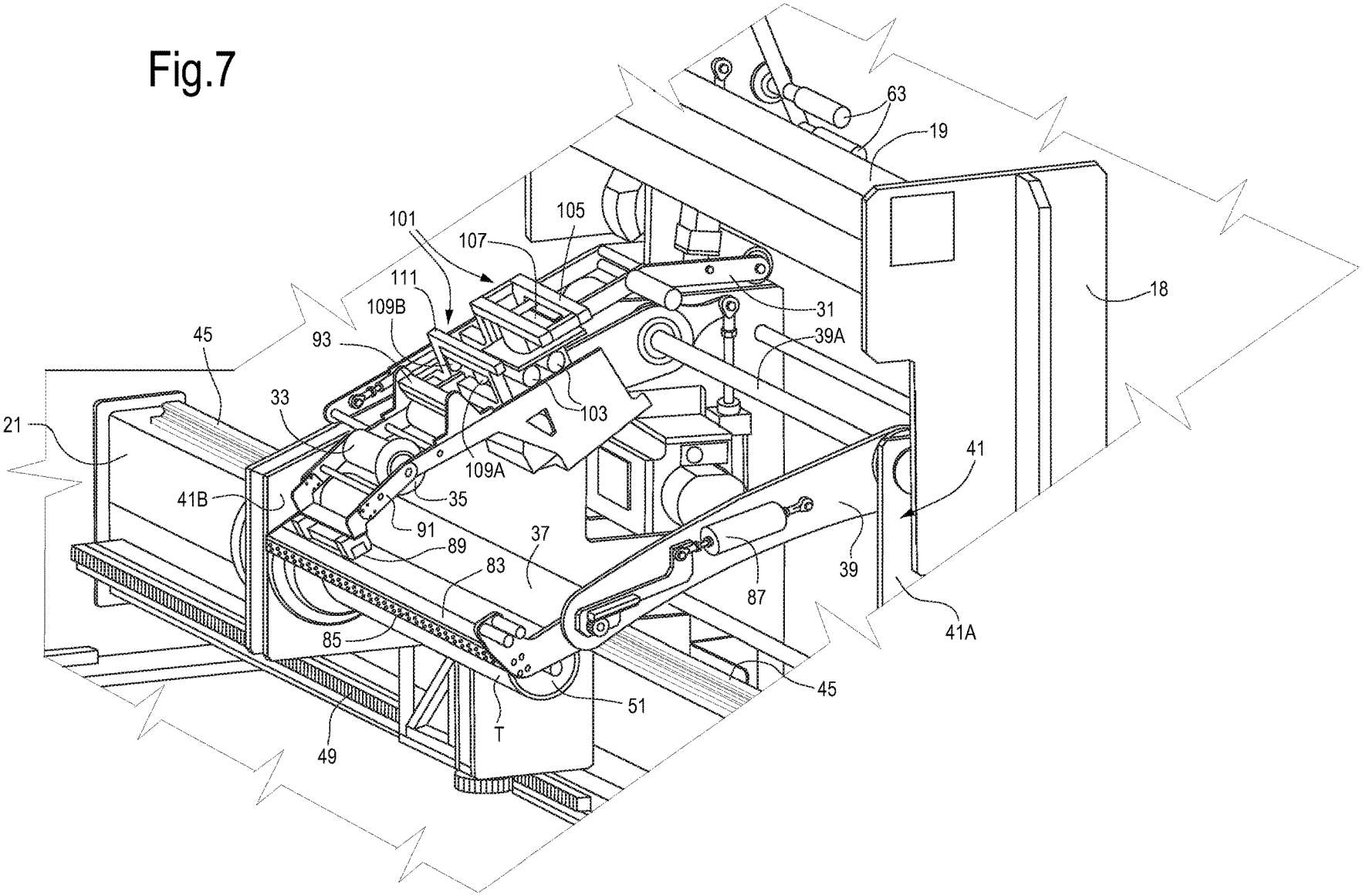
FIG. 7 shows an axonometric view of the elements to cut the longitudinal strip and start winding of the longitudinal strip on a new tubular winding core.

In some embodiments, as illustrated in the attached drawings, the counter blade 83 is formed as one piece with a suction box 85 (or integral therewith), which forms part of the holding device for the leading edge of the longitudinal strip S. The suction box 85 may be rotationally mounted around the axis of the contact roller 37. An actuator 87 (FIG. 7), for example a pneumatic or hydraulic cylinder-piston actuator, controls rotation of the suction box 85 around the axis of the contact roller 37 to take on various angular positions during the cutting cycle of the longitudinal strip S and application of the leading edge to a new tubular winding core.

In some embodiments, the guide arm 31 can be provided with an electrostatic bar 89 carried by pivoting brackets 91, hinged to the guide arm 31. The pivoting brackets 91 may be hinged, for example around the axis of the guide roller 33, or at another suitable point on the guide arm 31.

The guide arm 31 may also comprise a brake 93 that has the function of blocking the longitudinal strip S during or after the transversal cutting, to prevent it from being drawn back, for example due to the traction exerted on the strip itself.

The sequence in FIGS. 8A-8H show the cycle for severing of the longitudinal strip S at the end of winding of a helically wound spool B and starting winding of a new spool around a new tubular winding core T that is fitted on the winding mandrel 51 after removal of the completed spool B.

Figure 8A:
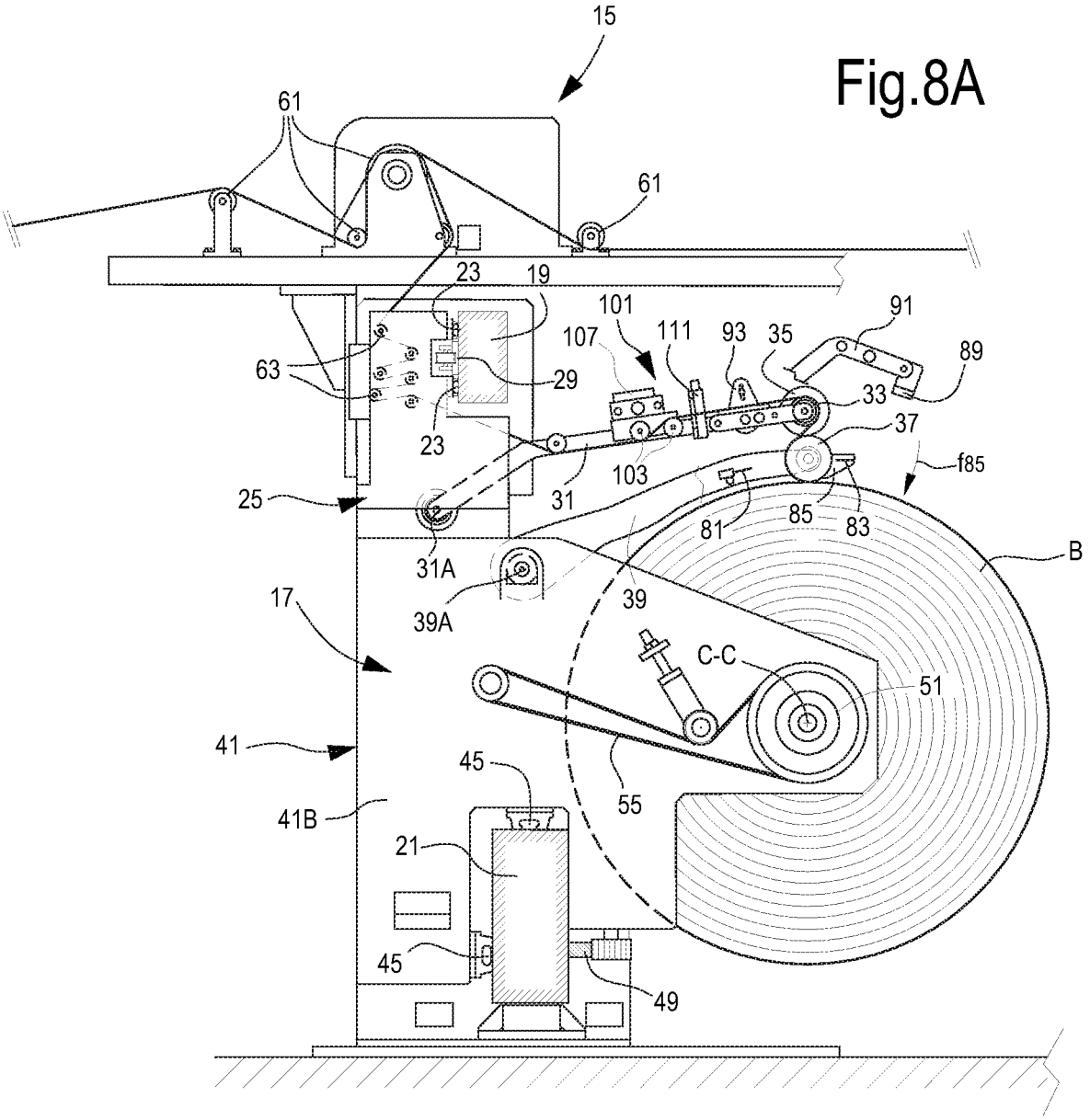
FIGS. 8A-8H show a working sequence of cutting a longitudinal strip at the end of winding of a spool and the start of winding of a new spool.

FIG. 8A shows the final phase of winding the spool B. The longitudinal strip S is guided around the guide roller 33 and around the contact roller 37. The suction box 85 is placed in an angular position such that, with respect to the contact roller 37, it is on the opposite side of the pivoting axis 39A of the arms 39.

Figure 8B:
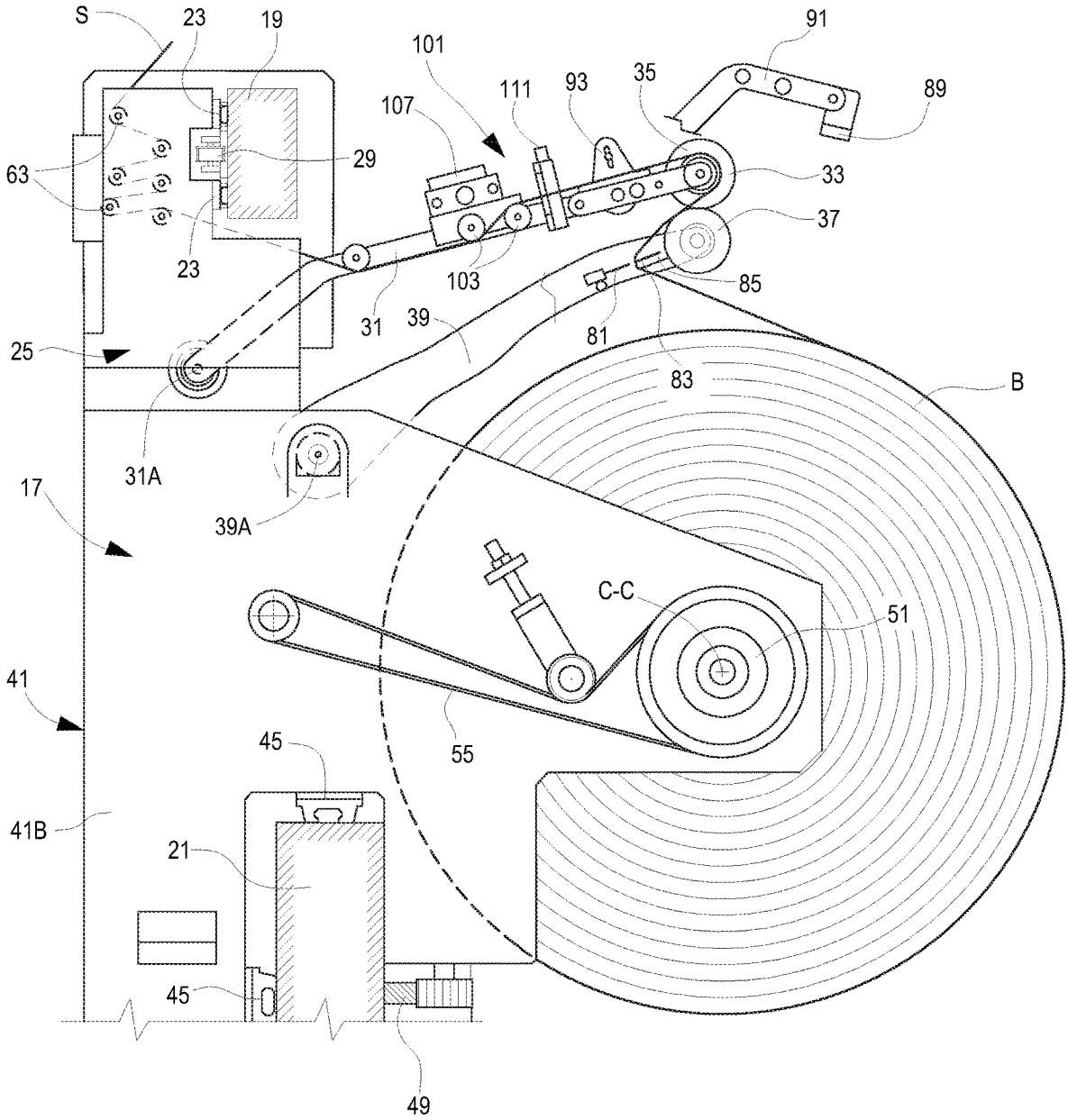

In FIG. 8B rotation of the winding mandrel 51 has been stopped and the arms 33 and 39 have been lifted, so that the contact roller 37 no longer rests on the helically wound spool B. The suction box 83 has been turned in the direction of the arrow f83 (FIG. 8A) so that it is turned towards the blade 81. In its rotating motion the suction box has moved the longitudinal strip S away from the contact roller 37. The counter blade 83 integral with the suction box 85 is now opposite the blade 81 and the longitudinal strip S of web material is between the counter blade 83 and the blade 81.

Figure 8C:
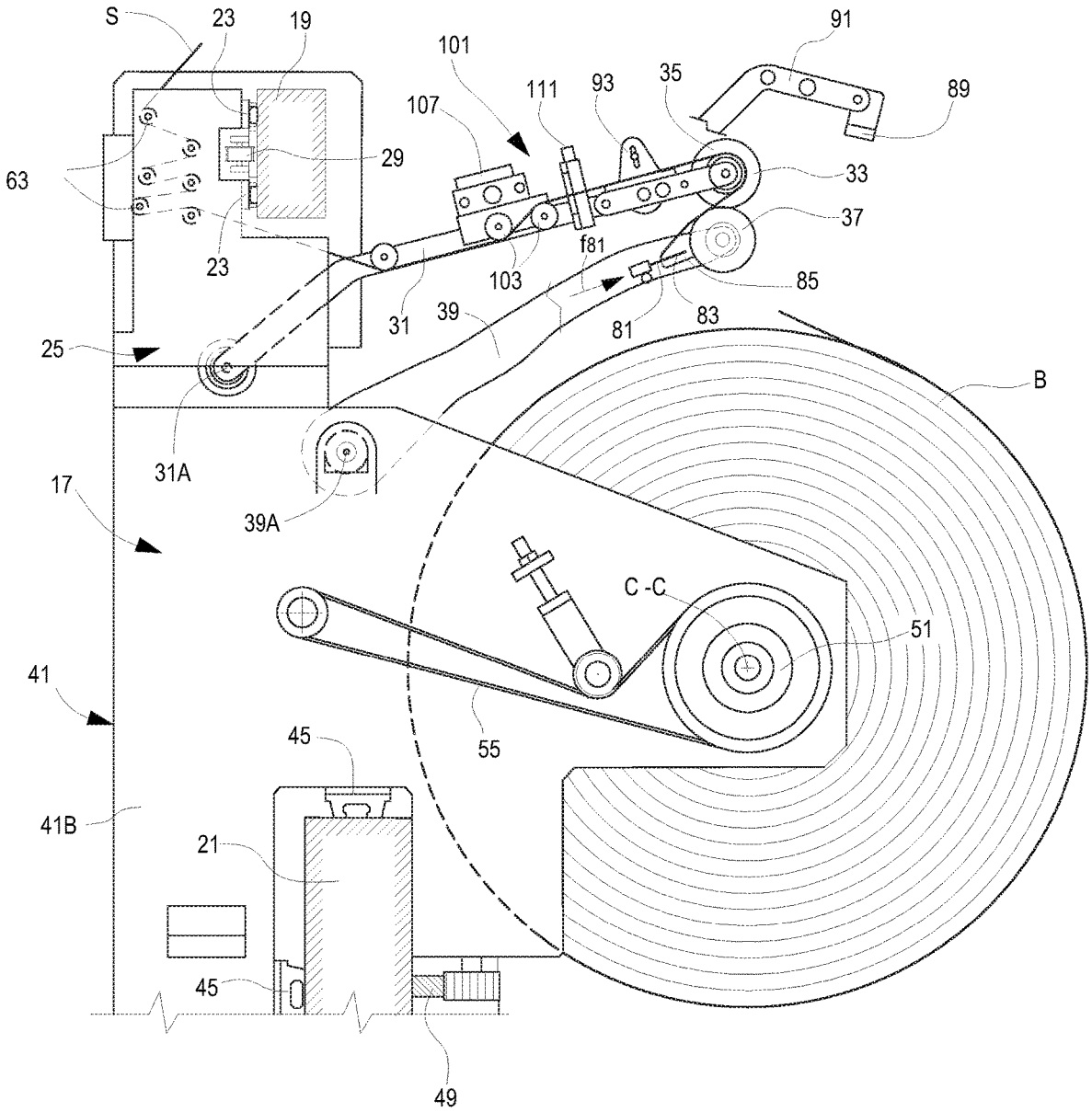

In the following FIG. 8C the blade 81 has been moved towards the counter blade 83 and has penetrated it, cutting the longitudinal strip S. In this way a tail, or trailing edge is formed, which remains on the helically wound spool B formed, and a head, or leading edge, which is held by suction on the surface of the suction box 85. To prevent the leading edge of the longitudinal strip S from being pulled back due to the tension in the longitudinal strip S, the brake 93 can be activated.

Figure 8D:
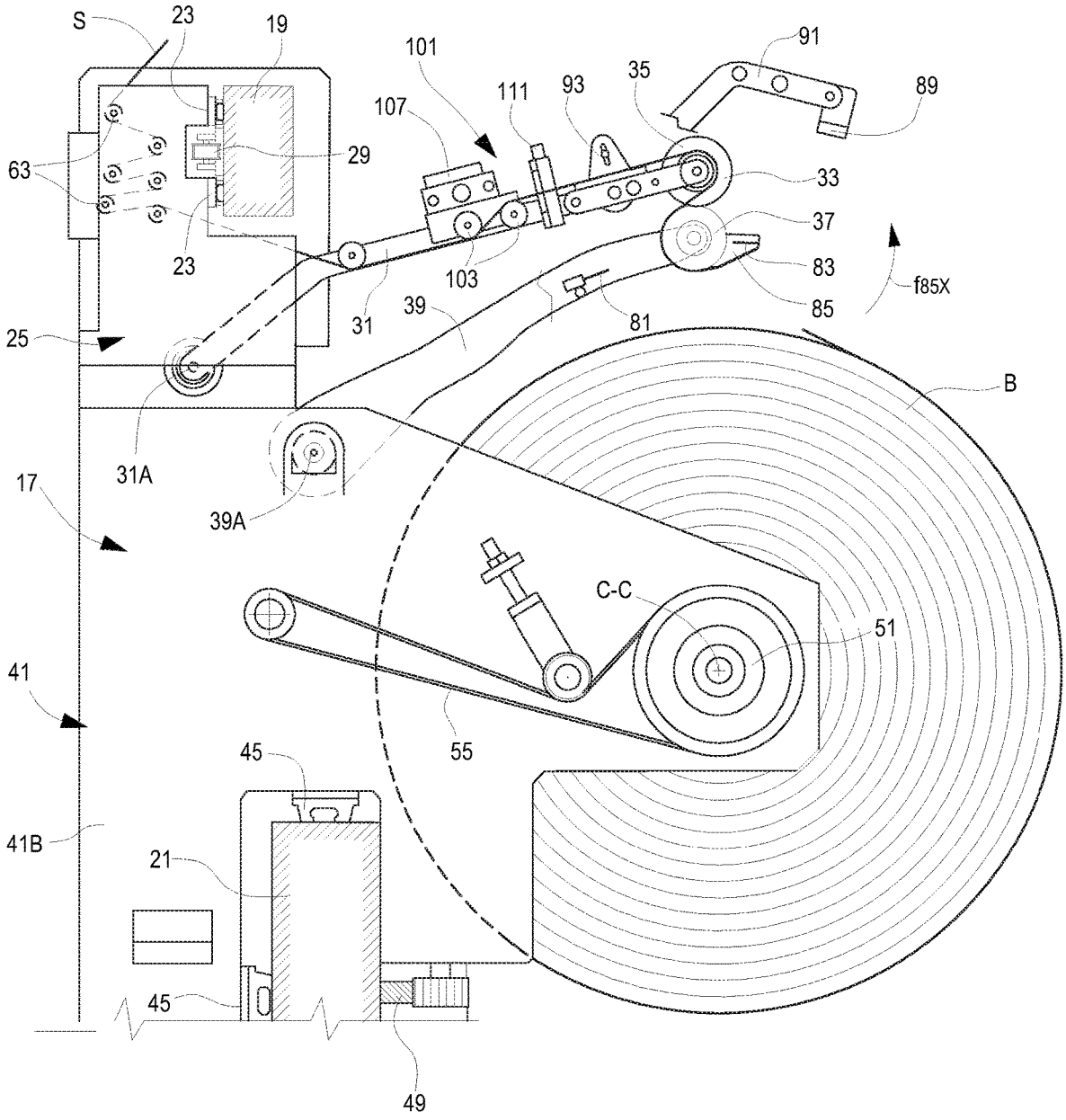

Subsequently the suction box 85 rotates in the direction indicated by the arrow f85*x*, moving to the position shown in FIG. 8D. The leading edge of the longitudinal strip S remains attached to the suction box 85 and is therefore brought forward by an amount sufficient to then be held between the rollers 33 and 37. For more reliable holding of the leading edge of the longitudinal strip, the suction box can have a radial dimension larger than that shown schematically in the attached drawings.

The helically wound spool B that has just been formed can be removed from the winding mandrel 51 and a new tubular winding core T can be inserted on said winding mandrel 51.

Figure 8E:
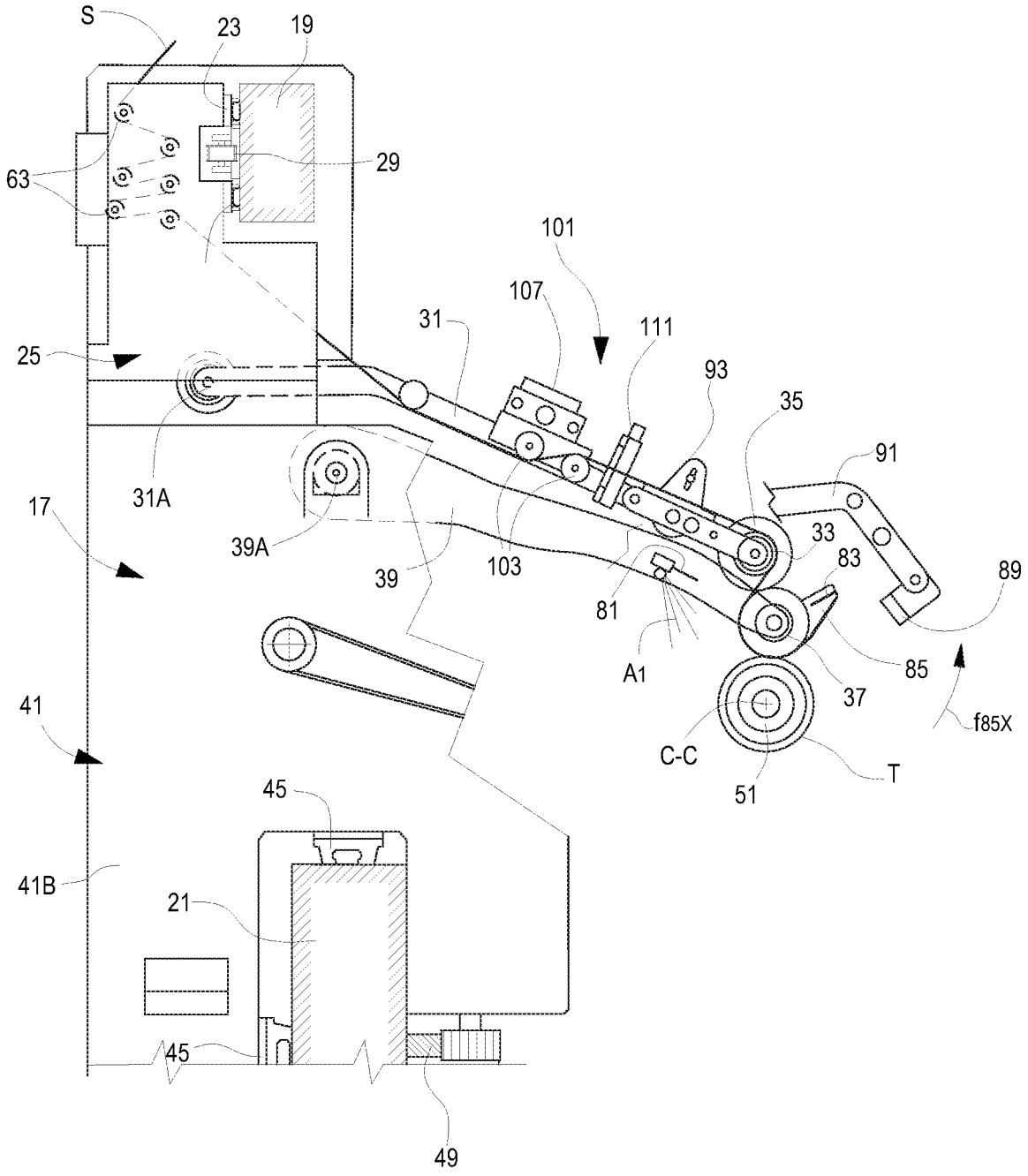

Once the new tubular winding core T has been inserted on the winding mandrel 51 it is locked to the mandrel, which for that purpose can be expandable, and the arms 39 and 33 can be lowered until the contact roller 37 is made to press against the external cylindrical surface of the new tubular winding core T. The starting portion of the longitudinal strip S, held through suction by the suction box 85, is pinched between the contact roller 37 and the tubular winding core T, as shown in FIG. 8E. The brake 93 can be deactivated, as the longitudinal strip S is now held by pinching between the contact roller 37 and the tubular winding core T.

The suction box 85 can be turned again in the direction of the arrow f85*x*. Nozzles carried by the arms 39 can be activated to generate air jets A1 that facilitate correct positioning of the starting edge or leading edge of the longitudinal strip S.

Figure 8F:
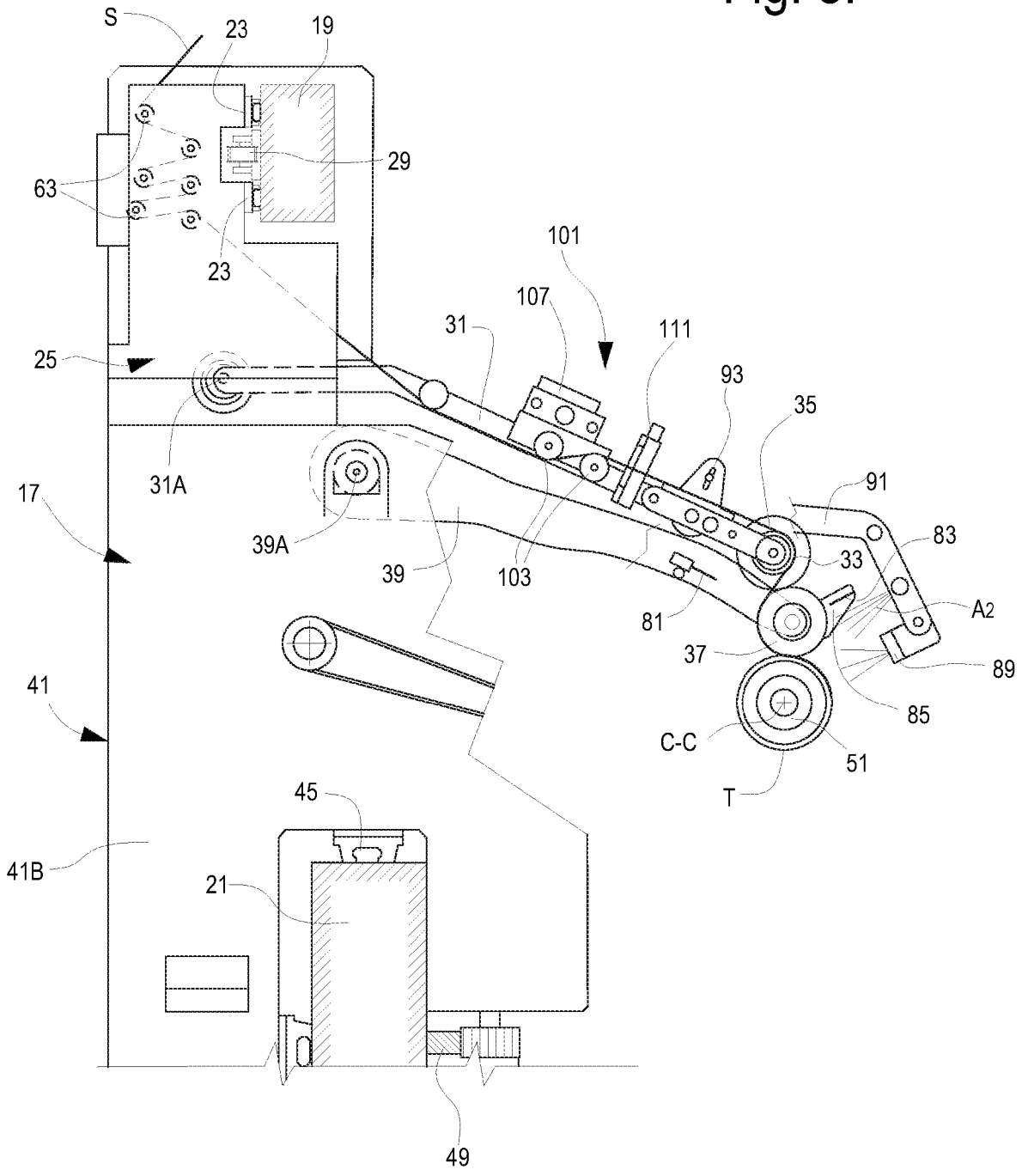

In the next step the electrostatic bar 89 can be rotated downwards so as to bring it in front of the external cylindrical surface of the tubular winding core T, as shown in FIG. 8F. Together with the electrostatic bar 89, a series of nozzles 91 can be lowered, which generate air jets A2 that help detaching the leading edge of the longitudinal strip S from the suction box 85, which can stop its suction action during this step.

The electrostatic bar 89 can be activated to electrostatically charge the tubular winding core T, having optionally first grounded the winding mandrel 51.

The combined effect of the actions described above mean that the leading edge of the longitudinal strip S adheres to the new tubular winding core.

Figure 8G:
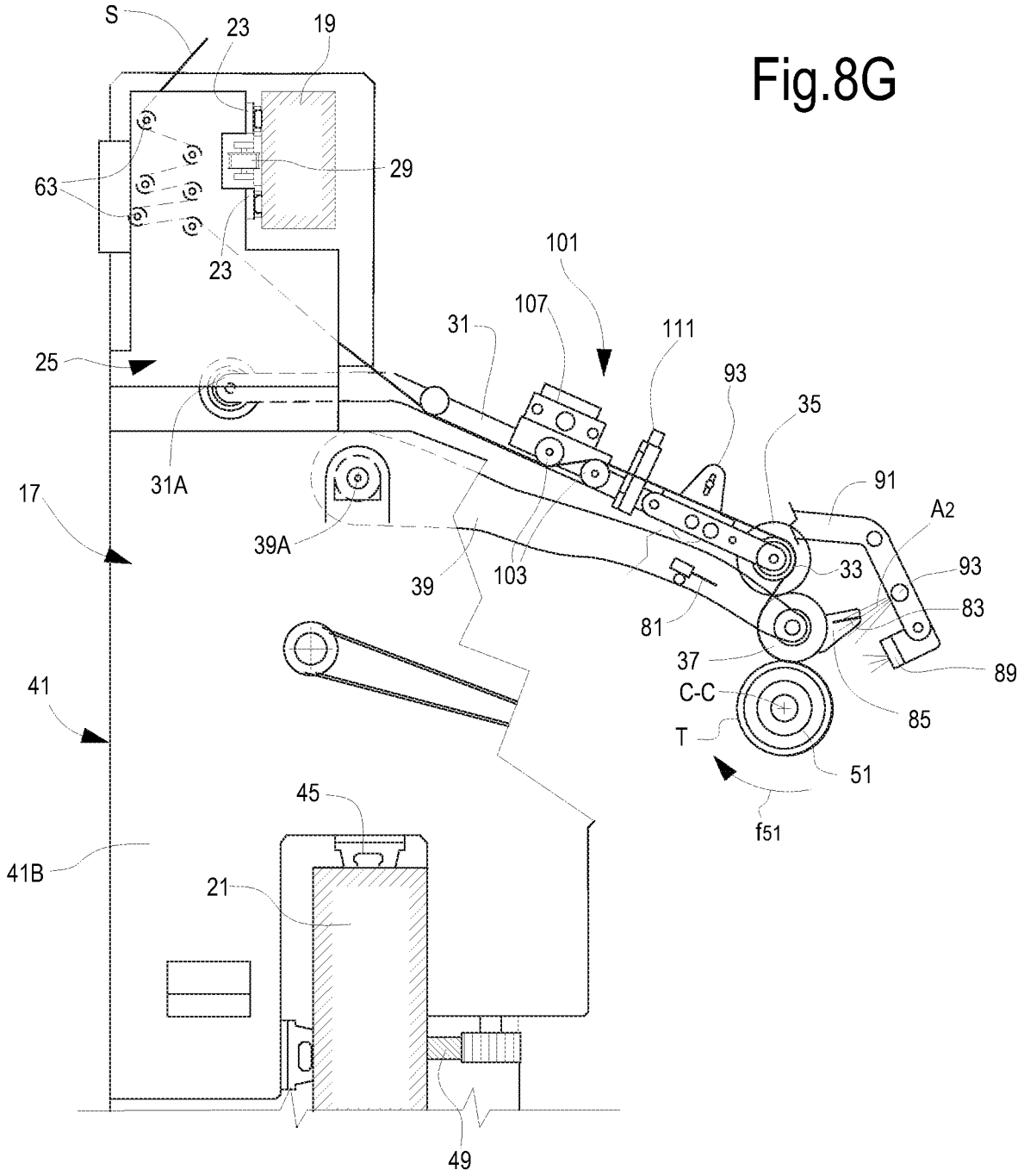
Figure 8H:
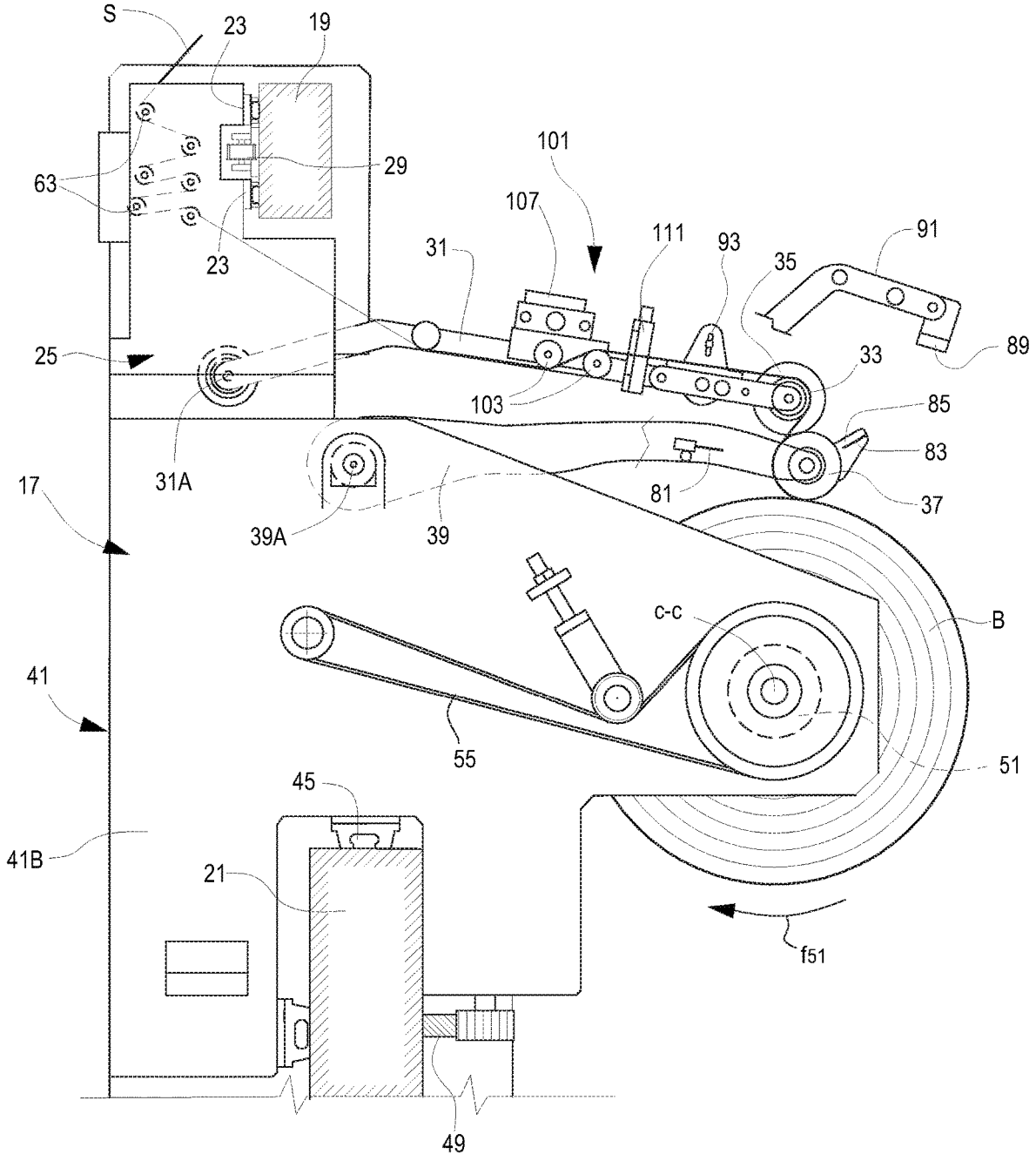

In the next step the winding mandrel 51 starts rotating (arrow f51 in FIGS. 8G and 8H, starting winding of the new helically wound spool B.

In the steps described above, when the air jets A1 are activated, the surface of the suction box can act as a surface to support and spread out the leading edge of the longitudinal strip S. If the air jets A1 are activated in a timely manner, the combined effect of the air jets A1 and rotation of the suction box 85 after cutting of the longitudinal strip S, causes the leading edge of the latter to be accompanied towards and beyond the nip between the roller 37 and the new tubular winding core T inserted on the winding mandrel 51. In this way any flapping or undesired deviations of the leading edge of the longitudinal strip S are avoided.

In some embodiments, the guide arm 31 can be fitted with a strip guiding device that corrects any transversal slipping in the longitudinal strip S. This is particularly useful when considering the great length of the path traveled by each longitudinal strip from the cutting station 13 to the respective winding station 15. Along that path, slipping in the longitudinal strip may occur that results in winding faults, if not suitably corrected. These faults are visible, in particular on the front surfaces of the spools, in the form of axial misalignments in the edges of the various overlapping turns that form the spool.

The stip guiding device is indicated as a whole with 101. It comprises a pair of idle rollers 103 with parallel axes. The axes of the rollers 103 can be approximately orthogonal to the machine direction, that is to say to the direction of movement of the longitudinal strip S, which is wound around the rollers themselves, following the guide path illustrated in FIG. 5 and schematically illustrated in the sequence of FIGS. 8A-8H. The guide rollers 103 are supported so that they can rotate integrally around an axis X-X (FIGS. 9A, 9B) set substantially at 90° to the rotation axes of the guide rollers 103. Rotation around the axis X-X can be controlled by an electric motor 107 or by any other suitable actuator. The rollers 103 and the electric motor 107 can be carried by a bracket 105 integral with the guide arm 31.

One or two sensors may be arranged downstream of the rollers 103 on the guide arm 31, which detect the transverse position of the longitudinal strip S. In the embodiment illustrated, two sensors 109A and 109B are provided, which can be mounted on a mounting bracket 111. The sensors 109A, 109B can be positioned at a reciprocal distance approximately corresponding to the width of the longitudinal strip S, or can have a reading field sufficiently broad as to identify the longitudinal edges of the longitudinal strip S for various transverse sizes thereof.

The sensors 109A, 109B can be associated with a control unit that controls rotation of the rollers 103 around the axis X-X to correct any side slipping, that is to say movements in a transverse direction with respect to the direction of advance, of the longitudinal strip S. The two sensors 109A, 109B can be activated selectively, or can be constantly active and their signals used selectively, according to the position of the winding mandrel 51 along the transfer trajectory (arrow f41).

The strip guiding device 101 described above allows precise winding of the longitudinal strip S to be obtained, in particular in the area of edges B1 and B2 of the helically wound spool B, correcting slipping of the longitudinal strip along the feeding path from the cutting station 13 to the spool B.

Operation of the strip guiding device 101 can be better understood with reference to the diagram in FIGS. 9A and 9B. These figures show: the helically wound spool B being formed, a portion of longitudinal strip S being wound and the two sensors 109A, 109B. FIGS. 9A, 9B show the two points at which the reciprocating straight movement of the winding mandrel 51, and therefore of the helically wound spool B, is reversed. In FIG. 9A the longitudinal strip S is in correspondence with the end B2: this is the end position reached in the movement according to arrow f41*x* in FIG. 9A (from right to left in the figure). The movement is reversed and the spool B moves as shown by the arrow f41*y* (FIG. 9B) until it reaches the position in which the longitudinal strip S is adjacent to the end B1 of the spool B. At this point the movement stops and reverses once again.

The sensors 109A and 109B are used in particular to correct any slipping in the longitudinal strip S in the vicinity of ends B1 and B2 of the helically wound spool B, so that on those ends the turns formed by the longitudinal strip S are properly overlapping, forming a clean, tidy spool, with ends B1, B2 defined by a surface that is as flat as possible.

For that purpose the sensors 109A, 109B may provide signals indicating the position of the longitudinal edges BL1 and BL2 of the longitudinal strip S to a control unit 115, which is interfaced with the electric motor 107. When the spool B is approaching the position shown in FIG. 9A, the signal from the sensor 109B is used, to check with precision the position of the edge BL2 and ensure that it is aligned with the end B2 of the spool B. If the sensor 109B detects an offset of the longitudinal edge BL2 with respect to the theoretical position, due for example to transversal slipping of the longitudinal strip S, this offset is corrected by the control unit 115, which controls rotation of the axes of the rollers 103 around the axis X-X, such that the side slipping is corrected.

A similar operation is foreseen when the longitudinal strip S approaches the end B1 of the spool B by translation of the winding mandrel 51 (FIG. 9B). In this case any slipping of the longitudinal strip S is detected using the sensor 109A, which detects the position of the longitudinal edge BL1.

This gives precise control of the winding, and correction of any slipping of the longitudinal strip S in the areas adjacent to the ends B1 and B2 of the helically wound spool B, so that the latter is wound with precision to form smooth, compact base surfaces, without any offset in an axial direction of the turns formed by the longitudinal strips S.

What is claimed is:

1. A machine for forming spools of web material, comprising:

an unwinding section for unwinding parent reels of web material;

a cutting station arranged downstream of the unwinding section and comprising cutting members adapted to divide the web material coming from the unwinding section into longitudinal strips;

a plurality of winding stations arranged in sequence downstream of the cutting station, each of which is adapted to receive a respective longitudinal strip; wherein each winding station comprises a winding device, to which the longitudinal strip of web material is fed, and in which a respective spool of web material is formed; the winding device being arranged and controlled to wind the longitudinal strip and to form the spool by rotation around a rotation axis of the spool;

wherein each winding device comprises a winding mandrel provided with a rotation movement around the rotation axis and with a reciprocating translation movement in a direction parallel to the rotation axis, so as to helically wind the longitudinal strip around the winding mandrel;

wherein each winding station further comprises: a strip cutting device for cutting the longitudinal strip transversely, thus forming a trailing edge, which remains on the spool under formation, and a leading edge; and a holding device for holding the leading edge of the longitudinal strip, to transfer the leading edge onto a tubular winding core of a new spool to be wound;

wherein a contact roller is associated with each winding mandrel, the contact roller rotating around a rotation axis and being adapted to be pressed against the outer surface of a spool being formed on the winding mandrel; and wherein the contact roller and the holding device are carried by a pivoting arm provided with a pivoting movement in order to move towards and away from the axis of the winding mandrel.

2. Machine according to claim 1, wherein the pivoting arm is mounted on a carriage carrying the winding mandrel and movable transversely with reciprocating motion in a direction parallel to the rotation axis of the winding mandrel.

3. Machine according to claim 2, wherein said pivoting arm carries at least a part of the cutting device.

4. Machine according to claim 1, wherein said pivoting arm carries at least a part of the cutting device.

5. Machine according to claim 1, wherein the holding device is movable between a first position, where it coacts with the cutting device to cut the longitudinal strip transversely, and a second position, where it holds the leading edge of the longitudinal strip between the contact roller and the tubular winding core of the new spool to be wound.

6. Machine according to claim 1, wherein the holding device is a suction device.

7. Machine according to claim 6, wherein the suction device comprises a suction box.

8. Machine according to claim 7, wherein the suction box is provided with a rotation movement around an axis parallel to the rotation axis of the spool.

9. Machine according to claim 8, wherein a contact roller is associated with each winding mandrel, the contact roller rotating around a rotation axis and being adapted to be pressed against the outer surface of a spool being formed on the winding mandrel; and wherein said suction box is provided with a rotation movement around the axis of the contact roller.

10. Machine according to claim 7, wherein a counter blade is integral with the suction box, the counter blade coacting with a blade, the counter blade and the blade forming the cutting device.

11. Machine according to claim 1, wherein the holding device comprises a suction box, and wherein the contact roller and the suction box have a length approximately equal to the length of the winding mandrel.

12. Machine according to claim 1, wherein the winding station further comprises an adhesion member in order to make the leading edge of the longitudinal strip adhere to a tubular winding core of a new spool to be wound.

13. Machine according to claim 12, wherein said adhesion member is an electrostatic member.

14. Machine according to claim 13, wherein the adhesion member comprises an electrostatic bar, configured and arranged to charge electrostatically the tubular winding core of the new spool to be wound.

15. Machine according to claim 12, wherein the adhesion member is mounted on a guiding arm for guiding the longitudinal strip.

16. Machine according to claim 15, wherein the guiding arm comprises a guiding roller with a rotation axis substantially parallel to the rotation axis of the spool.

17. Machine according to claim 16, wherein the guiding arm is carried by a slide movable parallel to the rotation axis of the spool.

18. Machine according to claim 15, wherein the adhesion member is provided with a movement with respect to the guiding arm in order to move towards and away from the rotation axis of the spool.

19. Machine according to claim 15, wherein each winding station comprises a brake to retain the longitudinal strip after cutting, the brake being arranged along a feeding path of the longitudinal strip, upstream of the cutting device with respect to the feeding direction of the longitudinal strip, and wherein the brake is mounted on the guiding arm.

20. Machine according to claim 1, wherein blowing nozzles are associated with the cutting device and the respective holding device, the blowing nozzles being configured and directed to facilitate detachment of the leading edge from the holding device and to facilitate the adhesion of the leading edge to the winding core of the new spool to be wound.

21. Machine according to claim 1, wherein each winding station comprises a brake to retain the longitudinal strip after cutting, the brake being arranged along a feeding path of the longitudinal strip, upstream of the cutting device with respect to the feeding direction of the longitudinal strip.

22. A method for winding a plurality of longitudinal strips on spools being formed in a plurality of winding stations, each spool rotating around a respective rotation axis and reciprocatingly translating parallel to said rotation axis, the method comprising the steps of:

winding a length of the longitudinal strip on first spools being formed in the winding stations, each strip being guided around a contact roller; each contact roller being supported by a respective pivoting arm and rotating around a rotation axis parallel to the rotation axis of the spool and pressed against the spool;

severing the longitudinal strips by means of cutting devices, forming trailing edges of the first spools and leading edges of second spools, each of the leading edges being held by means of a respective holding device, each holding device being supported by said pivoting arm to be movable towards and away from the axis of the rotation axis of the spool;

removing the first spools from the winding stations;

inserting new tubular winding cores into the winding stations;

by means of the holding devices, moving each one of said leading edges towards the respective new tubular winding cores;

making the leading edges adhere to the new cores;

starting winding new spools around the new tubular winding cores.

23. A machine for forming spools of web material, comprising:

an unwinding section for unwinding parent reels of web material;

a cutting station arranged downstream of the unwinding section and comprising cutting members adapted to divide the web material coming from the unwinding section into longitudinal strips;

a plurality of winding stations arranged in sequence downstream of the cutting station, each of which is adapted to receive a respective longitudinal strip; wherein each winding station comprises a winding device, to which the longitudinal strip of web material is fed, and in which a respective spool of web material is formed; the winding device being arranged and controlled to wind the longitudinal strip and to form the spool by rotation around a rotation axis of the spool;

wherein each winding device comprises a winding mandrel provided with a rotation movement around the rotation axis and with a reciprocating translation movement in a direction parallel to the rotation axis, so as to helically wind the longitudinal strip around the winding mandrel;

wherein each winding station further comprises: a strip cutting device for cutting the longitudinal strip transversely, thus forming a trailing edge, which remains on the spool under formation, and a leading edge; and a holding device for holding the leading edge of the longitudinal strip, to transfer the leading edge onto a tubular winding core of a new spool to be wound;

wherein a contact roller is associated with each winding mandrel, the contact roller rotating around a rotation axis and being adapted to be pressed against the outer surface of a spool being formed on the winding mandrel;

wherein the contact roller and the holding device are carried by a pivoting arm provided with a pivoting movement in order to move towards and away from the axis of the winding mandrel; and wherein the holding device is movable between a first position, where the holding device coacts with the cutting device to cut the longitudinal strip transversely, and a second position, where the holding device holds the leading edge of the longitudinal strip between the contact roller and the tubular winding core of the new spool to be wound.

* * * * *